US005899830A

United States Patent [19]

Tabata

[11] Patent Number: 5,899,830

[45] Date of Patent: May 4, 1999

[54] ELECTRONICALLY-CONTROLLED THROTTLE SYSTEM

[75] Inventor: Taro Tabata, Kariya, Japan

[73] Assignee: Denso Corporation, Kariya, Japan

[21] Appl. No.: 08/906,807

[22] Filed: Aug. 6, 1997

[30] Foreign Application Priority Data

Aug. 7, 1996 [JP] Japan ..... 8-207986

[51] Int. Cl.[6] ..... F02D 41/10

[52] U.S. Cl. ..... 477/111; 477/107; 123/399; 701/54; 701/99

[58] Field of Search ..... 477/107, 109, 477/110, 111; 123/361, 399; 701/54, 99; 180/335

[56] References Cited

U.S. PATENT DOCUMENTS

| | | | |
|---|---|---|---|
| 4,461,254 | 7/1984 | Pfalzgraf et al. | 123/350 |
| 4,691,676 | 9/1987 | Kikuchi | 123/399 |
| 4,771,849 | 9/1988 | Lieber et al. | 477/107 X |
| 4,852,008 | 7/1989 | Sager | 701/70 |
| 4,881,428 | 11/1989 | Ishikawa et al. | 477/110 |
| 5,209,207 | 5/1993 | Shitani et al. | 123/399 |
| 5,337,239 | 8/1994 | Okuda | 477/111 X |

FOREIGN PATENT DOCUMENTS

| | | |
|---|---|---|
| 0072395 | 2/1983 | European Pat. Off. . |
| 0279908 | 8/1988 | European Pat. Off. . |
| 0393929 | 10/1990 | European Pat. Off. . |
| A-3-78542 | 4/1991 | Japan . |
| A-4-203251 | 7/1992 | Japan . |
| 1603921 | 12/1981 | United Kingdom . |

*Primary Examiner*—Charles A. Marmor
*Assistant Examiner*—Ankur Parekh
*Attorney, Agent, or Firm*—Nixon & Vanderhye P.C.

[57] ABSTRACT

To suppress vehicle shock upon acceleration or deceleration, an upper guard value (KGUARD) for throttle rate of change is calculated based on parameters indicative of engine and torque transmission operating conditions. A target throttle sensor voltage change (DVVTA) is calculated based on accelerator depression and compared with the upper guard value KGUARD. If DVTTA>KGUARD, the final target throttle sensor voltage for the present cycle is determined by adding the upper guard value KGUARD to the previously calculated final throttle sensor voltage. If DVVTA≦KGUARD, the target throttle sensor voltage VTTA is used as the final target throttle sensor voltage.

10 Claims, 6 Drawing Sheets

FIG. 5

| THROTTLE OPENING (deg) | ENGINE ROTATION SPEED (rpm) | | | | |
|---|---|---|---|---|---|
| | 1000 | 2000 | 3000 | 4000 | 5000 |
| 2 | | | | | |
| 4 | | | | | |
| 6 | | | | | |
| 8 | | FIRST UPPER GUARD VALUES | | | |
| 10 | | | | | |
| 12 | | | | | |
| 20 | | | | | |
| 40 | | | | | |
| 60 | | | | | |

FIG. 6

| GEAR RATIO | TRANSMISSION SHIFT PATTERN | | | | |
|---|---|---|---|---|---|
| | 1 | 2 | 3 | 4 | 5 |
| 0 | | | | | |
| 1 | | | | | |
| 2 | | | | | |
| 3 | | SECOND UPPER GUARD VALUES | | | |
| 4 | | | | | |
| 5 | | | | | |
| 6 | | | | | |
| 7 | | | | | |

ELECTRONICALLY-CONTROLLED THROTTLE SYSTEM

BACKGROUND OF THE INVENTION

1. Field of the Invention

The present invention relates to an electronically-controlled throttle system which controls throttle opening angle electrically by driving a throttle valve by a motor or the like based on accelerator depression or the like.

2. Related Art

When throttle opening angle changes rapidly for vehicle acceleration or deceleration, engine torque changes greatly in a short time causing shock to a vehicle and uncomfortableness to vehicle passengers. JP-A 3-78542 and JPA-4-203251 disclose an electronic throttle control system for a vehicle which suppresses shock to a vehicle (vehicle shock) upon vehicle acceleration or deceleration. This system estimates required torque from accelerator depression and an engine rotation speed and filters the estimated torque by a filtering model matched to the vehicle to attenuate, by a predetermined attenuation rate, specified frequency components which are likely to cause vehicle shock. This filtering corrects the estimated torque in a direction to suppress vehicle shock. The system controls throttle opening angle in accordance with a target throttle opening angle calculated based on the corrected torque, thus suppressing vehicle shock at the time of rapid acceleration or deceleration.

This electronic throttle control system, however, calculates target throttle opening angle from corrected torque after estimating engine torque and correcting it by filtering estimated torque by the filtering model matched to the vehicle. Therefore, it not only makes complicated the control logic from the torque estimation to the target throttle opening angle calculation but also necessitates determination of matching constants for the filtering model varying from vehicle to vehicle. Determining such a complicated control logic and vehicle-specific filtering model requires an enormous amount of system development work, resulting in a longer development period and higher development cost.

SUMMARY OF THE INVENTION

The present invention has an object to provide an electronically-controlled throttle system which suppresses shock to a vehicle upon vehicle acceleration or deceleration with simplified control logic.

For attaining the above object, an electronically-controlled throttle system according to the present invention determines a guard value (i.e., limit value for suppressing shock to a vehicle) for a changing rate of a throttle valve opening angle based on vehicle operating conditions. It determines a target throttle opening angle to limit the changing rate of the throttle opening angle to less than the guard value based on accelerator depression amount. It then controls throttle driving member for driving the throttle valve so that the throttle opening angle is maintained at the target throttle opening angle. As the changing rate of the throttle opening angle is limited to less than the limit (vehicle shock suppression limit), the vehicle shock at the time of acceleration or deceleration can be suppressed assuredly.

According to this throttle control system, the vehicle shock upon acceleration or deceleration can be suppressed assuredly by the simplified control logic in which the guard value limits the changing rate of the throttle opening degree. Thus, the complicated control logic and vehicle-specific filtering model which has been conventionally required can be alleviated, thus shortening the system development period and reducing the development cost.

Preferably, at least one of engine rotation speed, throttle opening angle, transmission gear ratio and torque converter lock-up condition may be used as the vehicle operating conditions for determining the guard value. As those are all parameters which affect changes in engine torque and hence occurrence of vehicle shock, it is possible to determine the guard value most appropriate to the vehicle operating condition by determining the guard value based on at least one of those parameters.

In the case of a vehicle having a plurality of selectable shift patterns from which a transmission shift pattern such as "economy mode" for good fuel economy, "sporty mode" for good acceleration and "cruise control mode" for automatic cruising can be selected, the guard value may be determined by the transmission shift pattern selected by a driver.

For instance, smooth acceleration or deceleration is preferred in the "economy mode" or "cruise control mode" to quick response of the throttle operation (acceleration performance) in response to accelerator depression. Therefore, the guard value is determined relatively low against the changing rate of the throttle opening angle so that the vehicle shock is reduced to the least to improve riding comfort. On the contrary, when the "sporty mode" is preferred for good acceleration performance, the upper guard value is determined relatively high so that the response of the throttle operation against the accelerator depression is improved for good acceleration performance while tolerating the vehicle shock to some extent. Even in this case, as the excessively large vehicle shock can be suppressed by the guard value against the changing rate of the throttle opening angle, the vehicle shock is less and the riding comfort is better than in the case of no upper guard limitation.

BRIEF DESCRIPTION OF THE DRAWINGS

Other objects, features and advantages of the invention will become more apparent from the following detailed description when read with reference to the accompanying drawings, in which:

FIG. 5 is a table illustrating a two-dimensional map for calculating an upper guard value 1 from an engine speed and throttle opening angle;

FIG. 6 is a table illustrating a two-dimensional map for calculating an upper guard value 2 from a transmission shift pattern and gear ratio;

FIG. 8*a* is a characteristic chart illustrating a relation between a throttle opening angle, engine rotation speed and engine torque, while

DETAILED DESCRIPTION OF THE PRESENTLY PREFERRED EMBODIMENT

Figure 1:
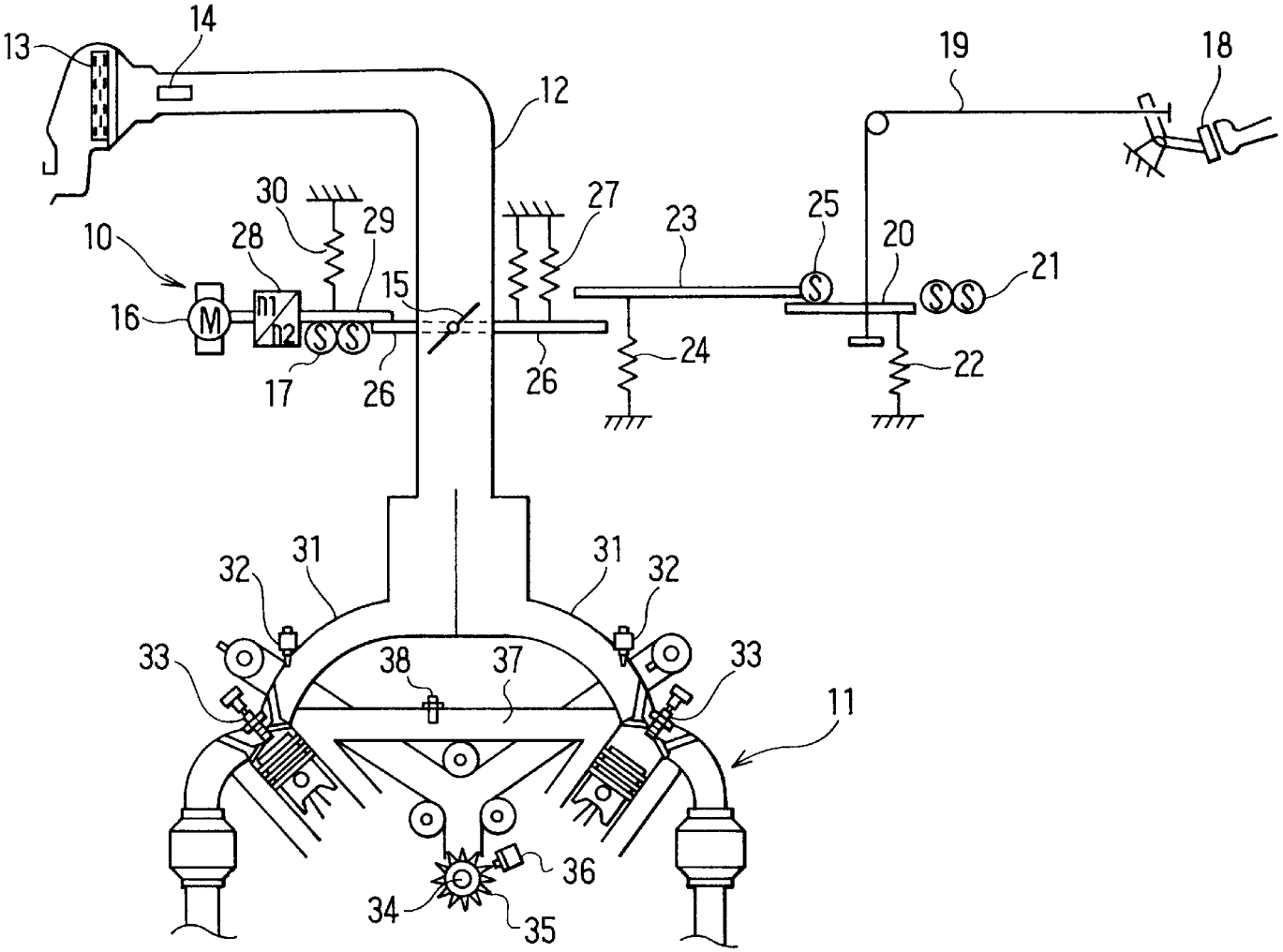
FIG. 1 is a schematic diagram of an entire engine control system illustrating one embodiment of the present invention.

The present invention will be described hereunder with reference to one embodiment illustrated in the drawings. As shown in FIG. 1, an engine 11 has an intake pipe 12 on which is fitted an air cleaner 13 at the most upstream, an air flow meter 14 at more downstream for measuring intake air quantity and a throttle valve 15 of an electronically-controlled throttle system (electronic throttle control system) 10 rotatable at the further downstream. The throttle valve 15 is driven by a direct current (DC) motor 16, and opening angle of the throttle valve 15 (throttle opening angle) is detected by a throttle sensor 17 operatively linked with the throttle valve 15.

An accelerator pedal 18 which adjusts the opening angle of the throttle valve 15 is linked with an accelerator lever 20 through a wire 19. The position of the accelerator lever 20 (accelerator opening angle) is detected by an accelerator sensor 21. The accelerator lever 20 is biased normally toward the throttle closing direction (downward in the figure) by an accelerator return spring 22.

A mechanical guard (lever) 23 which mechanically limits the maximum opening of the throttle valve 15 is biased toward the throttle closing direction (downward in the figure) by a spring 24. The position of the mechanical guard 23 (mechanical guard opening angle) is detected by a mechanical guard sensor 25. The lower opening angle of the mechanical guard 23 is limited by the accelerator lever 20 which moves responsively to the depression of accelerator pedal 18.

The left end of the mechanical guard 23 is located at the open side of a throttle lever 26 (upward in the figure) which rotates integrally with the throttle valve 15. The throttle lever 26 is biased toward the throttle opening direction (upward in the figure) by a spring 27. The relation between the biasing forces of the spring 27 of the throttle lever 26 and the spring 24 of the mechanical guard 23 is so determined that the latter is larger than the former. The left end of the throttle lever 26 is held by the spring 27 in abutment against a throttle driving lever 29 linked with the DC motor 16 through a reduction gear 28. The throttle driving lever 29 is biased toward the throttle opening direction (upward in the figure) by a spring 30.

Though the throttle valve 15 is normally biased toward the throttle opening direction (upward in the figure) by the spring 27, the opening of the throttle valve 15 is allowed only to a position where the throttle lever 26 comes into abutment with the mechanical guard 23. Once the throttle lever 26 abuts against the mechanical guard 23, the biasing force of the spring 24 of the mechanical guard 23 restricts the throttle valve 15 from moving or opening thereafter. Thus, the throttle opening angle is restricted to the mechanical guard opening angle determined by the position of the mechanical guard 23 which responds to the accelerator pedal 18.

Injectors 32 are fitted on intake manifolds 31 which lead intake air passing through the throttle valve 15 to respective cylinders of the of the engine 11. An ignition plug 33 is fitted on the cylinder head of each cylinder of the engine 11. A crank angle sensor 36 is positioned in opposition to the outer periphery of a signal rotor 35 fitted on a crankshaft 34 of the engine 11. Engine rotation speed NE is detected from the interval of pulses of engine rotation signal generated in pulse form by the crank angle sensor 36. A coolant temperature sensor 38 is fitted on a coolant recirculating passage 37 of the engine 11 for detecting the coolant temperature.

Figure 2:
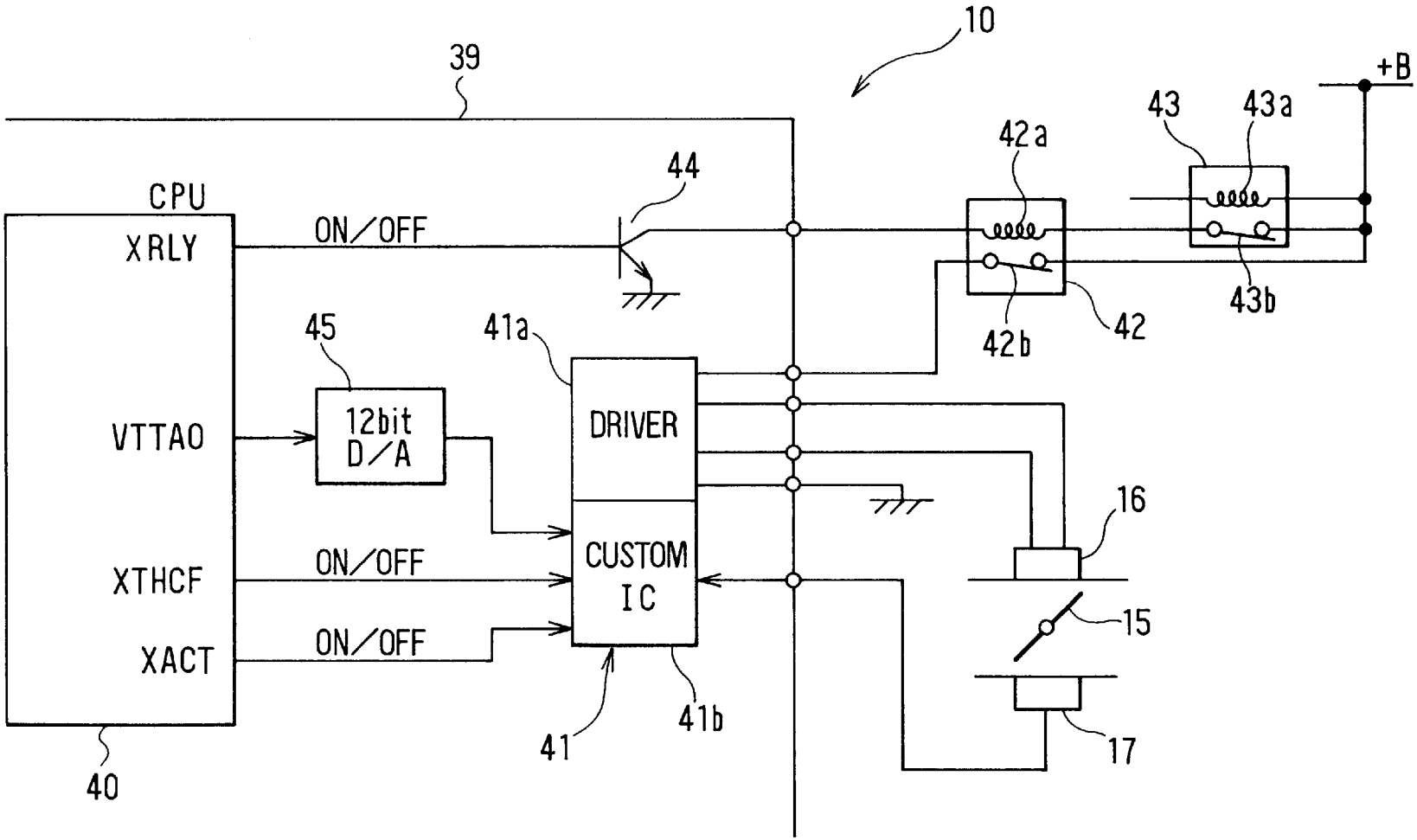
FIG. 2 is an electric wiring diagram of an electronic throttle control system.

The outputs from those sensors are applied to an electronic control unit (ECU) 39 illustrated in FIG. 2. The ECU 39 comprises primarily a microcomputer including a CPU 40, ROM (not illustrated), RAM (not illustrated) and the like to calculate, based on prestored engine control programs, ignition timing and fuel injection quantity in response to engine operating conditions detected by the above sensors for controlling the operation of the ignition plug 33 and the injector 32. The ECU 39 also controls the opening angle of the throttle valve 15 (throttle opening angle) to a later-described final target throttle opening angle by controlling the DC motor 16 of the electronic throttle system 10.

The ECU 39 has a motor driving power module 41 which comprises a motor driving circuit 41*a* for driving the DC motor 16 and a customized integrated circuit (IC) 41*b* for receiving the output voltage of the throttle sensor 17. The ECU 39 feedback controls the DC motor 16 through the motor driving circuit 41*a* based on the output voltage of the throttle sensor 17 so that the actual throttle opening angle is maintained at the final target throttle opening angle.

The motor driving circuit 41*a* is powered from a battery (+B) via a motor relay 42. The motor relay 42 is a normally-open type in which a contact 42*b* turns on when a coil 42*a* is energized. Energization and deenergization for the coil 42*a* is controlled by a normally-open type control relay 43 and a transistor 44 which is turned on by a high output level at an output port of a motor relay driving flag XRLY of the CPU 40. In the control relay 43, a coil 43*a* is energized to turn on a contact 43*b* when an ignition switch (not illustrated) is turned on. The base of the transistor 44 with its emitter being grounded is connected to the output port of the motor relay driving flag XRLY of the CPU 40, while the collector of the transistor 44 is connected to the coil 42*a* of the motor relay 42.

In this construction, the transistor 44 turns on when the ignition switch turns on (control relay 43 turns on) and the output level of the output port of the motor relay driving flag XRLY of the CPU 40 is high (XRLY=ON). Thus, when the motor relay 42 turns on by the energization of the coil 42*a*, the motor driving power module 41 is supplied with the electric power. The motor relay driving flag XRLY is ON when the motor relay driving requirements are satisfied in the CPU 40.

The CPU 40 has, in addition to the motor relay driving flag XRLY, output ports from which a final target throttle sensor voltage VTTAO, malfunction flag XTHCF and motor driving flag XACT are produced. The final target throttle sensor voltage VTTAO (digital value) calculated by the CPU 40 in the manner described hereafter is applied to a D/A converter 45 of, for instance, 12-bit to be converted into an analog value (0 through 5 V) and inputted to the customized IC 41*b* of the motor driving power module 41. The customized IC 41*b* compares the output voltage of the throttle sensor 17 (actual throttle opening angle) with the final target throttle sensor voltage VTTAO (final target throttle opening angle) to feedback control the DC motor 16 through the motor driving circuit 41*a* so that the two values coincide in the end.

In the event of occurrence of malfunction in the electronic throttle control system 10, the malfunction flag XTHCF is reversed and the motor driving flag XACT is reversed to OFF. This stops control operation of the motor driving power module 41 and, by reversing the motor relay driving flag XRLY to OFF and turning off the motor relay 42, stops the power supply to the motor driving power module 41.

Figure 3:
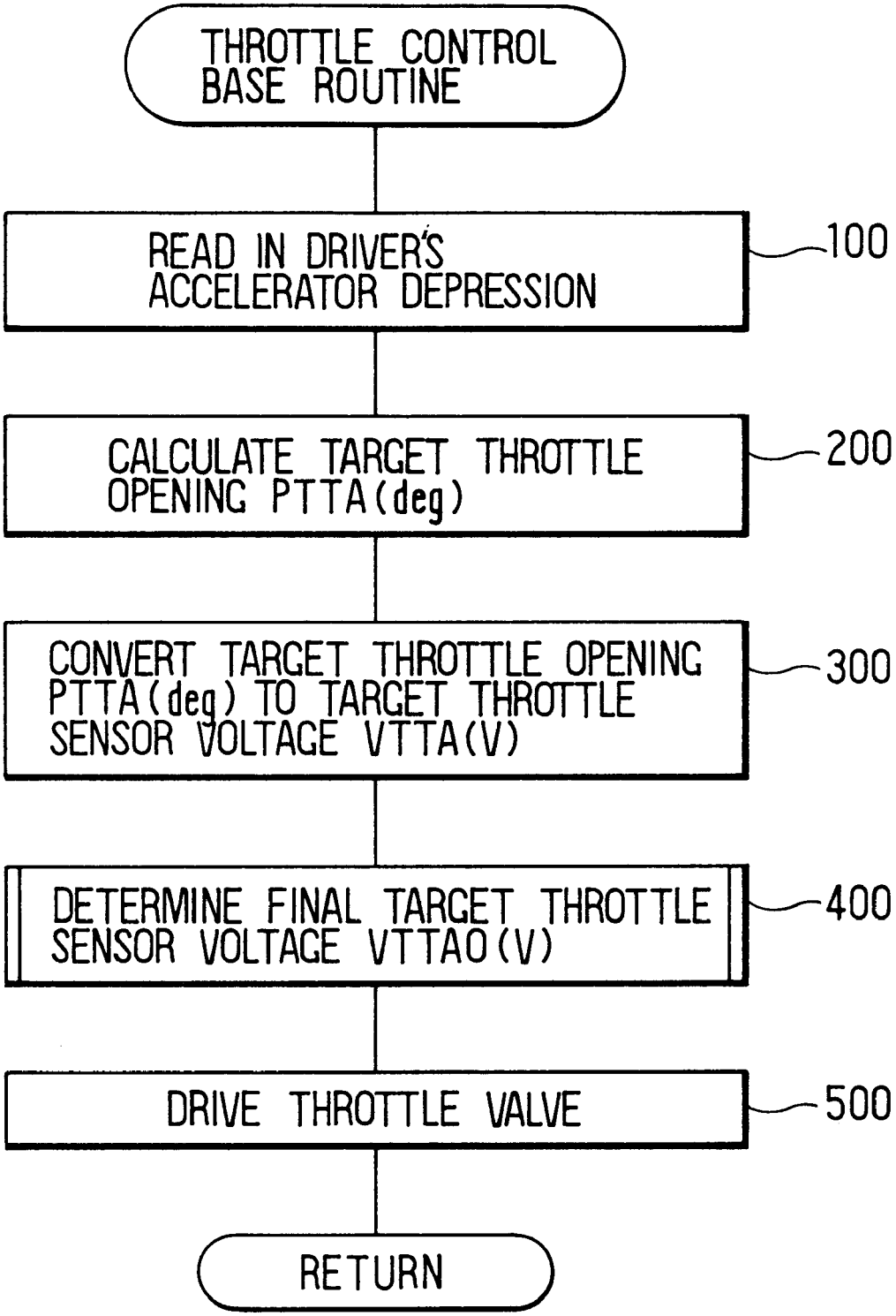
FIG. 3 is a flowchart illustrating a processing in a throttle control base routine.
Figure 4:
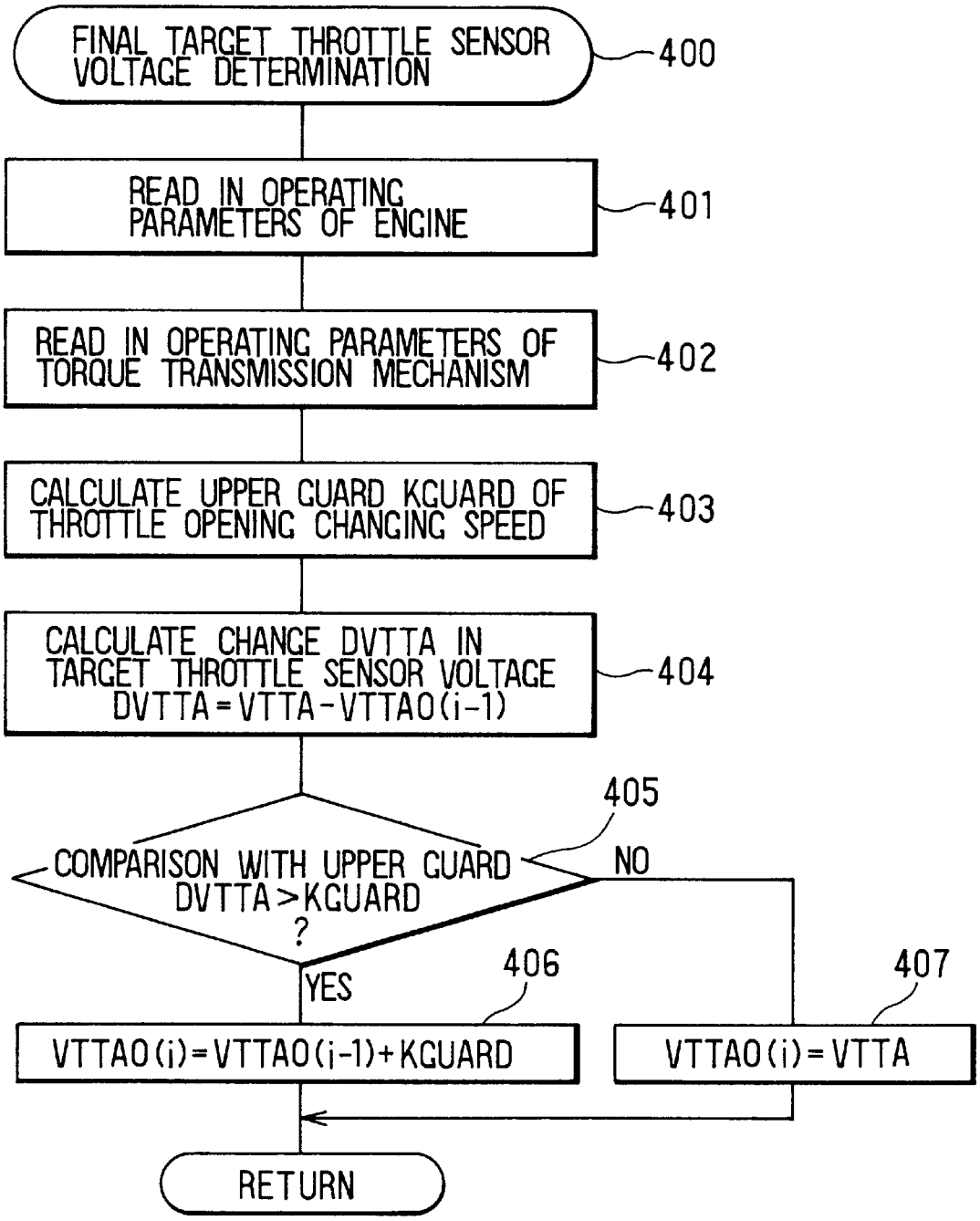
FIG. 4 is a flowchart illustrating a processing in a final target throttle sensor voltage determining routine.

The CPU 40 in the ECU 39 performs the throttle control by executing control routines illustrated in FIGS. 3 and 4.

A throttle control base routine illustrated in FIG. 3 starts by an interrupt at every predetermined time interval or predetermined crank angles. When this routine starts, step 100 reads in the driver's accelerator depression amount (output voltage of the accelerator sensor 21) and step 200 calculates a target throttle opening angle PTTA(deg) from mapped data or the like prestored in correspondence with the accelerator depression amount. The target throttle opening angle PTTA is calculated in consideration of conditions of the cruise control, traction control and the like.

Thereafter, step 300 converts the target throttle opening angle PTTA(deg) into the target throttle sensor voltage VTTA(V) by the use of prestored conversion table data.

Step 400 executes a later-described final target throttle sensor voltage determination routine illustrated in FIG. 4 to determine the final target throttle sensor voltage VTTAO(V) which controls the DC motor 16. This final target throttle sensor voltage VTTAO corresponds to the final target throttle angle converted into the output voltage of the throttle sensor 17.

In the processing of the final target throttle sensor voltage determination routine illustrated in FIG. 4, step 401 reads in the engine rotation speed, throttle opening angle and the like which are parameters indicative of engine operating conditions. Subsequently, step 402 reads in the transmission gear ratio, torque converter lock-up condition and the like which are parameters indicative of operating conditions of the torque transmission mechanism (not illustrated) for transmitting the engine output torque to wheels. Step 403 calculates the upper guard value KGUARD against the changing rate of the throttle opening angle.

This upper guard value KGUARD is for limiting the changing rate of the throttle opening angle so that the vehicle shock at the time of rapid acceleration or deceleration. This may be calculated in the following manner as an example. FIGS. 5 and 6 illustrate examples of calculating the upper guard values. FIG. 5 illustrates a two-dimensional data map for calculating an upper guard value 1 from the engine rotation speed and the throttle opening angle, while FIG. 6 illustrates a two-dimensional map for calculating an upper guard value 2 from the transmission shift pattern and the gear ratio. Here, the transmission shift pattern also includes variations of "economy mode" for a better fuel economy, "sporty mode" for a better acceleration performance, "cruise control mode" for an automatic cruise running and the like.

A more preferable upper guard value can be determined by using both of the two-dimensional maps illustrated in FIGS. 5, i.e., by taking into account both of the operating conditions of the engine and the torque transmission mechanism. In this instance, the final upper guard value KGUARD may be calculated by the following multiplication, for example.

$$KGUARD = \text{upper guard value } 1 \times \text{upper guard value } 2$$

In the two-dimensional map of FIG. 6, the mapped data may be varied based on the lock-up condition of the torque converter. This is because the engine torque applied to driving wheels will change in accordance with the lock-up condition.

Figure 7:
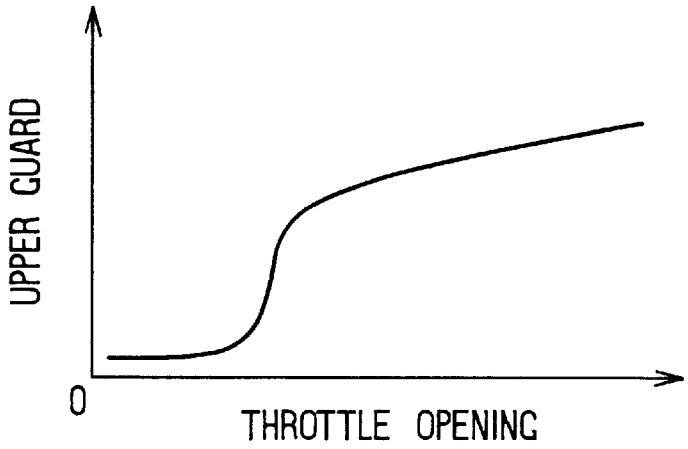
FIG. 7 is a chart illustrating schematically a map for calculating an upper guard value from a throttle opening angle.

It is to be understood that, because the vehicle shock caused upon rapid acceleration depends most primarily on the initial changing rate of the throttle opening angle at the time of start of changes in the throttle opening angle, most of the vehicle shock may be suppressed by reducing the rapid opening of the throttle at the time of the start of acceleration. Therefore, the upper guard value may preferably be determined based on the throttle opening angle as illustrated in FIG. 7, for example. According to the guard characteristics in FIG. 7, the upper guard value is decreased in the region of smaller opening degree where the engine torque changes greatly in response to the changes in the throttle opening degree so that changes in the throttle opening angle is smoothed to suppress the vehicle shock. In the region of medium or larger opening angle where the engine torque changes less in response to the changes in the throttle opening angle, the upper guard value is determined higher so that rapid opening of the throttle is allowed to the extent necessary to improve response characteristics against the changes in the throttle opening angle. Thus, the vehicle shock can be suppressed effectively while reducing to a minimum the influence affecting the response characteristics of acceleration or deceleration.

Figure 8A:
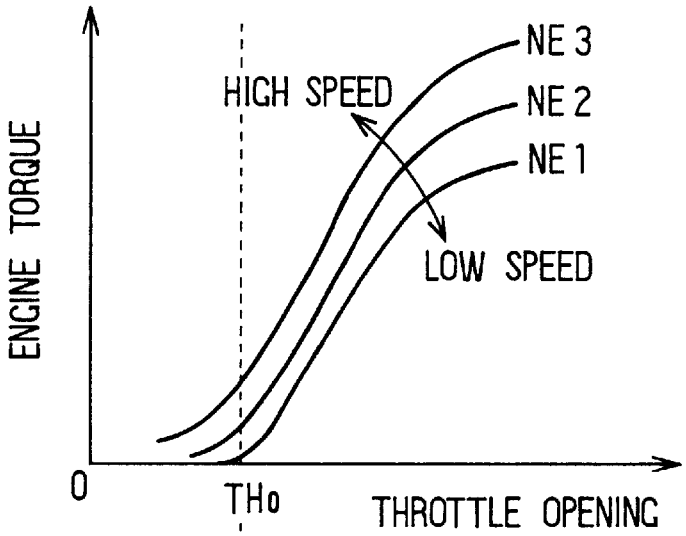
Figure 8B:
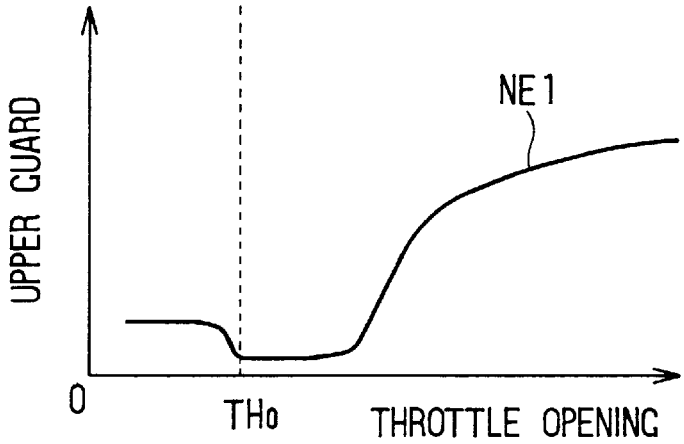
FIG. 8*b* is a characteristic chart illustrating schematically another example of a map for calculating an upper guard value from throttle opening angle.

It is also possible to determine the upper guard value as follows from the relation between the throttle opening angle and the engine torque. For instance, in the case there exists the engine rotation speed region (low speed region below NE1) where the engine torque rarely changes until the throttle opening angle exceeds a predetermined opening angle THo as illustrated in FIG. 8*a*, the upper guard value is determined a little large up to the throttle opening angle THo below which the engine torque changes less as illustrated in FIG. 8*b* to improve the response characteristics against the changes in the throttle opening angle. In the medium opening region where the engine torque rises rapidly, the upper guard value is determined low to smooth the opening motion of the throttle valve 15 for suppressing the vehicle shock. Further, in the large throttle opening region where the engine torque changes the least, the upper guard value is determined large to allow the rapid opening of the throttle to the extent necessary for improving the response characteristics against the changes in the throttle opening angle. Thus, the influence affecting the response characteristics of the throttle system 10 at acceleration or deceleration can be reduced to a minimum and the vehicle shock can be effectively suppressed.

After determining the upper guard value KGUARD as described above, the processing proceeds to step 404 of FIG. 4 to calculate by the following equation a change amount DVTTA of the target throttle sensor voltage VTTA calculated in the step 300 of FIG. 3.

$$DVTTA = VTTA - VTTAO(i-1)$$

Here, VTTAO(i−1) indicates a previously calculated value of the final target throttle sensor voltage and is equivalent to a value which has been calculated in step 406 or 407 to be described later in the previous execution of this routine.

The following step 405 compares the change amount DVTTA of the target throttle sensor voltage VTTA with the upper guard value KGUARD calculated in the step 403. If DVTTA >KGUARD, the processing proceeds to step 406 to determine the final target throttle sensor voltage VTTAO(i) of the present execution cycle as follows by adding the upper guard value KGUARD to the previous value VTTAO(i−1).

$$VTTAO(i) = VTTAO(i-1) + KGUARD$$

Thus, the change amount of the final target throttle sensor voltage VTTAO is limited to the upper guard value KGUARD.

If DVTTA≦KGUARD, on the other hand, the processing proceeds from the step 405 to step 407 to set the target throttle sensor voltage VTTA calculated in the step 300 of FIG. 3 as the final target throttle sensor voltage VTTAO without any correction.

After determining thus the final target throttle sensor voltage VTTAO in the step 406 or 407, the processing proceeds to step 500 of FIG. 3 to produce the final target throttle sensor voltage VTTAO to the customized IC 41*b* of the motor driving power module 41. The motor driving power module 41, comparing the output voltage of the throttle sensor 17 (actual throttle opening angle) with the final target throttle sensor voltage VTTAO (final target throttle opening angle), feedback controls the DC motor 16 so that the two voltages equal.

In the electronic throttle control system according to the above-described embodiment, the vehicle shock upon acceleration or deceleration can be suppressed assuredly. Particularly, not only the vehicle shock can be reduced optimumly irrespective of the transmission gear ratio but also the vehicle shock arising specifically from a torque transmission system connecting a gear transmission to wheels.

In the present embodiment, as the parameter of the vehicle operating condition for determining the upper guard value, engine rotation speed, throttle opening angle, transmission gear ratio and shift pattern, torque converter lock-up condition and the like are exemplified. It is of course not necessary to use all of those parameters. Rather, the upper guard value may be determined by using at least the engine rotation speed, throttle opening angle and transmission gear ratio.

As additional parameters other than the above-described ones, engine operating condition parameters such as the intake air amount, intake air pressure, vehicle speed and the like, stiffness of a suspension or tire air pressure may be used. It is only essential that the upper guard is determined by using parameters which will affect occurrence of the vehicle shock.

Although the upper guard value is calculated by using the data map, it may be calculated by using a mathematical equation.

Further, although the upper guard value is set for the acceleration, another upper guard value against deceleration speed may be also set for the deceleration in the same manner so that the shock upon deceleration may be suppressed as well.

The present invention may be altered without departing from the spirit of the invention, with such alteration including changes in construction of the electronic throttle control system.

What is claimed is:

1. An electronically-controlled throttle system for an engine having a throttle valve and an accelerator, said system comprising:

throttle driving means for driving the throttle valve;

guard determining means for determining a guard value for a changing rate of the throttle opening angle based on vehicle operation conditions including at least a torque converter lock-up condition;

target throttle opening determining means for determining a target throttle opening angle based on accelerator depression, the target throttle opening determining means determining the target throttle opening angle to limit the changing rate of the throttle opening angle to less than the guard value determined by the guard determining means; and controlling means for controlling the throttle driving means so that actual throttle opening angle is maintained at the target throttle opening angle.

2. A system as in claim 1, wherein:

the guard determining means determines the guard value based on vehicle operating conditions including at least one of engine rotation speed, throttle opening angle, transmission gear ratio in addition to a torque converter lock-up condition.

3. A system as in claim 1, wherein:

the guard determining means determines the guard value based on a transmission shift pattern selected by a vehicle driver.

4. An electronically-controlled throttle system for an engine having a throttle valve, said system comprising:

guard determining means for determining a guard value for a changing rate of a throttle opening angle based on vehicle operating conditions including at least a torque converter lock-up condition;

target throttle opening determining means for determining a target throttle opening angle and limiting the changing rate of the throttle opening angle to less than the guard value determined by the guard determining means; and controlling means for producing a signal to drive the throttle valve so that the actual throttle opening angle is maintained at the target throttle opening angle.

5. A throttle control method for an engine having a throttle valve, an accelerator and a transmission mechanism, said method comprising:

determining a target throttle opening angle for the throttle valve based on accelerator depression;

determining a guard value for a changing rate of the throttle opening angle based on vehicle operating conditions including at least a torque converter lock-up condition;

determining the changing rate of the throttle opening angle from the determined target throttle opening angle and an actual throttle opening angle;

determining a final target throttle opening angle by limiting the changing rate of the throttle opening angle to the determined guard value when the changing rate exceeds the determined guard value; and controlling the throttle opening angle by the final target throttle opening angle.

6. A method as in claim 5, wherein:

the guard value determining step determines the guard value from parameters indicative of operating conditions of the engine and a transmission mechanism.

7. A throttle control method for an engine having a throttle valve, an accelerator and a transmission mechanism, said method comprising:

determining a target throttle opening angle for the throttle valve based on accelerator depression;

determining a guard value for a chanting rate of the throttle opening angle based on vehicle operating conditions;

determining the changing rate of the throttle opening angle from the determined target throttle opening angle and an actual throttle opening angle;

determining a final target throttle opening angle by limiting the changing rate of the throttle opening angle to the determined guard value when the changing rate exceeds the determined guard value; and controlling the throttle opening angle by the final target throttle opening angle, wherein the guard value determining step determines the guard value from an actual throttle opening angle at a start of acceleration/deceleration of the engine, the guard value being determined to be smaller as the actual throttle opening angle decreases.

8. A throttle control method for an engine having a throttle valve, an accelerator and a transmission mechanism, said method comprising the steps of:

determining a target throttle opening angle for the throttle valve;

correcting the target throttle opening angle by a power transmitting condition of the transmission to reduce shock, the power transmitting condition including a lock-up condition; and electrically driving the throttle valve to the corrected target throttle opening angle.

9. A throttle control method as in claim 8, wherein the correcting step includes the steps of:

determining a change in the target throttle opening between a previous time and a current time;

determining a guard value based on the transmission shift pattern and the lock-up condition; and determining the target throttle opening angle to be a value which is a sum of the previous target throttle opening angle and guard value, when the change exceeds the guard value.

10. A throttle control method as in claim 8, wherein:

the power transmission condition further includes at least one of (a) a transmission shift pattern, and (b) a gear ratio of the transmission.

* * * * *